United States Patent [19]

Jacobi, Jr. et al.

[11] Patent Number: 4,501,072

[45] Date of Patent: Feb. 26, 1985

[54] DRYER AND PRINTED MATERIAL AND THE LIKE

[75] Inventors: Cecil T. Jacobi, Jr.; Charles G. Maupin; James B. Woodsmall; William J. Brown; Bruce E. Thomas, all of Marshall; Walton D. Owens, Slater; Robert J. Cunningham; Rocky D. Smith, both of Marshall, all of Mo.

[73] Assignee: Amjo, Inc., Marshall, Mo.

[21] Appl. No.: 512,724

[22] Filed: Jul. 11, 1983

[51] Int. Cl.[3] ..... F26B 3/34; F26B 13/00; F27B 9/06

[52] U.S. Cl. ..... 34/1; 34/18; 34/23; 34/26; 34/46; 34/155; 219/343; 219/347; 219/354; 219/388; 219/405; 219/411; 266/103

[58] Field of Search ..... 34/18, 23, 26, 46, 48, 34/49, 55, 155, 1; 219/388, 343, 347, 354, 405, 411; 432/59; 266/103

[56] References Cited

U.S. PATENT DOCUMENTS

| | | | |
|---|---|---|---|
| 1,916,561 | 7/1933 | Crosley | 219/343 |
| 2,038,457 | 4/1936 | Venturini | 34/155 |
| 2,065,070 | 12/1936 | Hansen | 101/416 |
| 2,186,032 | 1/1940 | Mann | 34/18 |
| 2,236,754 | 4/1941 | Gurwick | 101/416 |
| 2,308,767 | 1/1943 | Mayes | 34/46 |
| 2,347,407 | 4/1944 | Goodwin et al. | 219/388 |
| 2,900,738 | 8/1959 | Offen | 34/155 |
| 3,031,556 | 4/1962 | Lasko et al. | 219/19 |
| 3,122,999 | 3/1964 | Visser | 101/180 |
| 3,159,464 | 12/1964 | Early et al. | 34/4 |
| 3,275,799 | 9/1966 | Meltzer | 219/354 |
| 3,683,154 | 8/1972 | Kipple et al. | 219/405 |
| 4,146,974 | 4/1979 | Pray | 219/343 |
| 4,220,847 | 9/1980 | Focke et al. | 219/388 |
| 4,266,117 | 5/1981 | Pardue et al. | 219/343 |

FOREIGN PATENT DOCUMENTS

| | | | |
|---|---|---|---|
| 636767 | 5/1950 | United Kingdom | 34/18 |

OTHER PUBLICATIONS

"Infrared Drying Systems for Sheet Fed and Web Offset Presses", Electro Sprayer Systems, Inc., 1981.

*Primary Examiner*—John J. Camby
*Attorney, Agent, or Firm*—Litman, Day & McMahon

[57] ABSTRACT

A dryer for printed material and the like including a frame structure with upper and lower heater panel assemblies vertically movably mounted therein. Each heater panel assembly includes a plurality of quartz tube heat lamps. The heater panel assemblies are reciprocated between open and closed positions by a pneumatic cylinder. An air handling system includes a drying air subsystem, a cooling air subsystem and an exhaust system. A control system includes an infrared detector for determining the temperature of printed material in the dryer and automatically adjusts the output of the heat lamps to maintain a predetermined web temperature.

30 Claims, 14 Drawing Figures

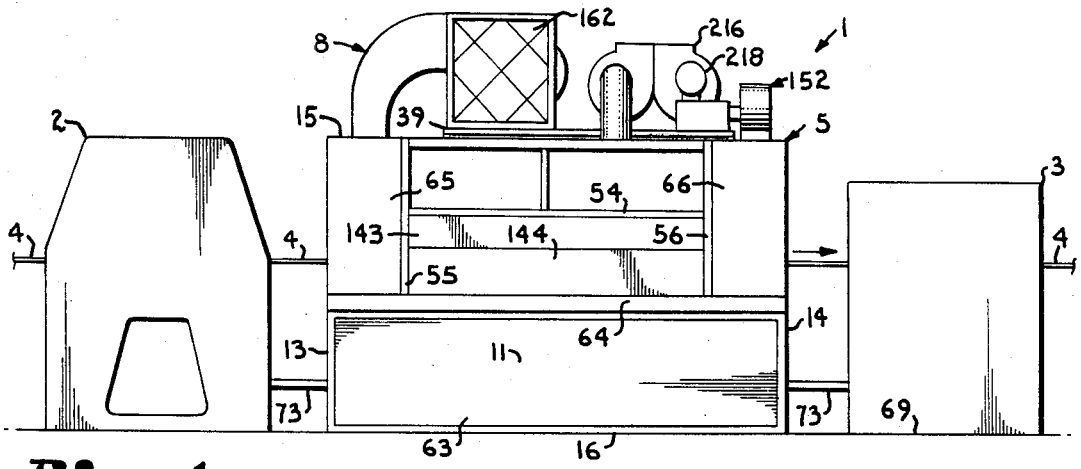
Fig. 1.
Fig. 2.
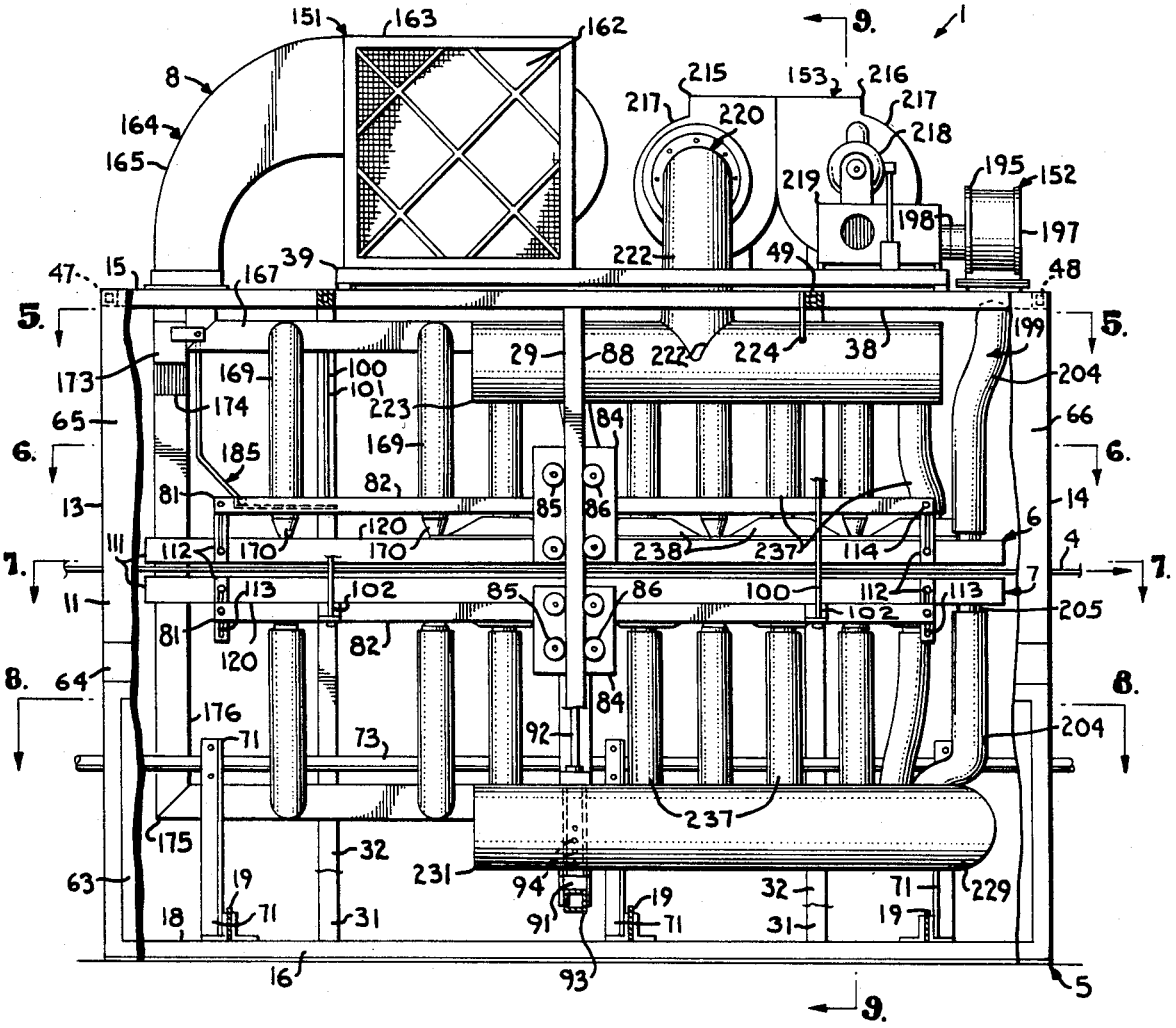

DRYER AND PRINTED MATERIAL AND THE LIKE

BACKGROUND OF THE INVENTION

1. Field of the Invention

This invention relates generally to dryers for printed materials and the like, and in particular to a dryer for printed webs utilizing infrared radiant heat and forced air.

2. Description of the Prior Art

In the printing field, dryers are often employed to shorten the drying time of inks and dyes applied to various materials such as paper and paperboard stocks, metallic foils, plastic films and cloth. Such materials may be printed in the form of either individual sheets or in continuous webs.

Printing inks and dyes generally contain solvents, varnishes and pigments which evaporate after sufficient exposure to ambient atmospheric conditions. However, in printing operations it is frequently desirable to hasten the drying process so that the printed materials may be stacked, rewound, cut, folded or otherwise further processed without smearing the ink or dye thereon.

One method of reducing the drying time involves the application of anti-offset powder to the freshly printed materials. The powder absorbs the solvents in the ink or dye to prevent smearing when the materials are further processed. However, the powder and the equipment for its application increase the printing costs. Also, drying powder tends to disperse widely around the area of the printing operation, interferes with equipment, and must be periodically cleaned up whereby the printer incurs additional maintenance costs by its use.

A variety of different dryers and ovens have been devised for applying heat to freshly-printed material. For example, tunnel ovens have heretofore been provided for transferring heat to webs of printed material. In tunnel ovens, the heat exchange occurs primarily by convection. However, tunnel ovens tend to be relatively large and are therefore unsuitable where floor space is limited. Also, they are relatively inefficient because much of the heat generated thereby is absorbed by the atmosphere and the surrounding structure instead of the printing material and the ink thereon.

Radiant heaters are generally more efficient in drying operations than convective heaters because radiant energy is transmitted through the atmosphere with very little loss and is absorbed by liquids and solids. Therefore, relatively little radiant energy is wasted through absorption into the atmosphere. Furthermore, radiant energy may be directed with reflectors and the like so that most of it is received and absorbed by the printed material in a dryer.

Yet another advantage of using radiant energy for drying printed materials relates to the control and elimination of pollutants found in the evaporated solvents, varnishes and pigments of inks and dyes. Prior art forced air-type convection dryers which include burners for natural gas, propane or fuel oil generally emit substantial amounts of pollutants in the form of evaporated solvents, varnishes and pigments. Accordingly, air pollution control equipment such as afterburners for thermal and catalytic incineration and electrostatic precipitators for particulates must be provided in order to satisfy applicable environmental protection laws and regulations and to meet local code requirements. However, a large portion of the aforementioned pollutants from a drying operation may be incinerated within the dryer or otherwise converted to a less harmful condition by radiant energy. Therefore, dryers which employ radiant energy require less pollution control equipment than convection-type dryers of comparable capacity or else require no pollution control equipment.

In particular, short and medium wave infrared energy with wavelengths of 0.75 to 1.5 and 1.5 to 3.0 microns respectively is effective for drying and incinerating the solvents, varnishes and pigments in printing inks and dyes. The wavelength of infrared radiation is determined by the temperature of the emitting body with higher temperatures producing shorter wavelengths. Short and medium wave infrared radiation penetrates deeper and is more intense than long wave infrared radiation. Although all bodies not at absolute zero emit infrared radiation, quartz tube heat lamps offer several advantages. First of all, they are relatively efficient in converting input electricity into radiant heat for drying ink and dye solvents, varnishes and pigments with minimal heat loss through absorption into the ambient atmosphere. For example, quartz tube heat lamps are available with an operational efficiency of approximately 89%.

Secondly, quartz tube heat lamps tend to have a relatively low thermal mass and thus can be switched on and off relatively rapidly. In drying wet materials, this is particularly important as a safety feature because in the event of a web stoppage, it is important to remove the heat therefrom immediately to avoid igniting the stopped web.

Furthermore, the output of quartz tube heat lamps can be relatively precisely controlled by varying the electrical input to their filaments. Thus, a web of printed material may be run at a constant speed through a dryer or oven and the precise amount of radiant heat required for proper drying can be applied by such control means. Drying systems lacking such precise control means are not only wasteful of energy, but may actually harm the printed product. For example, if the ink is not sufficiently dry, it is more susceptible to smearing. On the other hand, excessive heat can weaken the cellulose in the printed material, break the web or ignite it.

To take advantage of the aforementioned characteristics of infrared heating, many modern printing systems employ inks which are especially formulated to dry quickly when exposed to infrared radiant energy.

The drying of ink and dye and solvents on printed materials may also be hastened by directing a drying fluid such as air, oxygen or ozone over the printed material. Without such a fluid flow, heat-induced drying is less efficient because the evaporated solvent tends to collect in a layer over the printed material. The evaporated solvent insulates the printed material from radiant and convection heat and inhibits further solvent evaporation. Although movement of a web of printed material accounts for a certain amount of air circulation, a system for forcing drying fluid through the dryer in conjunction with a heat source is preferred.

Quartz tube heat lamps and forced drying fluid systems are known in the printing art as exemplified by the Hanson U.S. Pat. No. 2,065,070; the Early et al. U.S. Pat. No. 3,159,464 and the Visser U.S. Pat. No. 3,122,999. However, a persistent problem not effectively solved by the prior art relates to the immediate removal of the radiant heat from the web in the event of a stoppage for any reason. If the heat is not removed quickly enough, the web may be scorched, ignited and broken. Although quartz tube heat lamps have relatively low thermal masses as aforementioned, the high operating temperatures required to produce short wave infrared radiation increase the risk of web damage if the heat lamps are not immediately withdrawn a safe distance from the stopped web. Also, many prior art dryers were ineffective at reducing the level of pollutants in their exhausts.

Heretofore quartz tube heat lamps and a forced air system have not been available in a dryer designed to reduce the exhaust pollutant level and to automatically remove the heat source from the printed material as required to safely operate the heat lamps in the short wave infrared range.

SUMMARY OF THE INVENTION

In the practice of the present invention, a dryer for printed material and the like is provided which includes a frame structure having upper and lower heater panel assemblies with quartz tube heat lamps. The heater panel assemblies are vertically movable between open and closed positions with respect to a web of printed material by actuator means comprising a pneumatic cylinder. An air handling system includes a drying air subsystem for directing a flow of drying air across the web, a cooling air subsystem for cooling heat lamp wires and an exhaust subsystem for removing the drying air from the dryer.

The principal objects of the present invention are: to provide a dryer for printed materials and the like; to provide such a dryer which applies infrared radiant energy to printed material and the like; to provide such a dryer with quartz tube heat lamps; to provide such a dryer which reduces the level of pollutants in its exhaust; to provide such a dryer which reduces the exhaust pollutant level by incinerating pollutants with radiant energy within the dryer; to provide such a dryer with means for automatically and quickly removing the heat from a web of printed material in the event of a web stoppage; to provide such a dryer with an air handling subsystem for applying a flow of drying air to the printed material; to provide such a dryer with a cooling air subsystem for cooling heat lamp wires; to provide such a dryer with an exhaust air subsystem for removing evaporated solvent-laden drying air therefrom; to provide such a dryer with a photoelectric detector for determining the temperature of a web of printed material; to provide such a dryer which is particularly adapted for drying a web of printed material; to provide such a dryer which is capable of drying a web of printed material moving at a relatively high speed therethrough; to provide such a dryer which is relatively clean in operation; to provide such a dryer which efficiently transfers energy to the printed material; and to provide such a dryer which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a front elevational view of a dryer embodying the present invention shown between a rotary printing press and a chiller.

FIG. 2 is a front elevational view of the dryer with portions broken away to reveal the internal construction thereof.

DETAILED DESCRIPTION OF THE PREFERRED EMBODIMENTS

Figure 3:
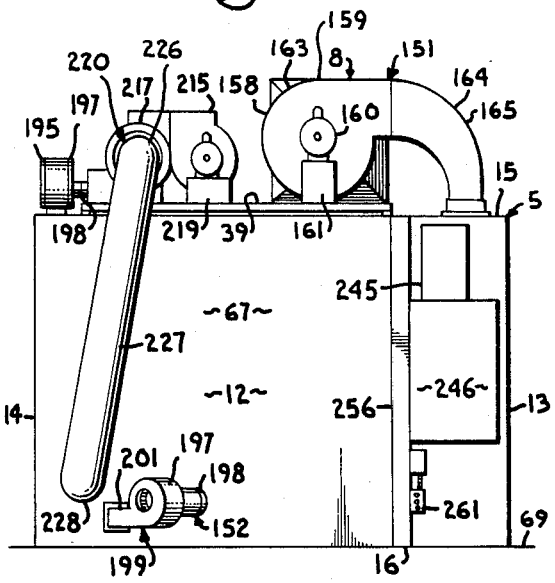
FIG. 3 is a rear elevational view of the dryer.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

As used herein, the terms "upper", "lower", "front", "back", "right", "left" and derivatives thereof refer to the invention as oriented in FIG. 1. However, it is understood that the present invention may assume alternative orientations except where expressly specified to the contrary.

Referring to the drawings in more detail, the reference numeral 1 generally designates a dryer for printed materials and the like. In the preferred embodiment of the present invention, the dryer 1 is operably positioned between a web offset rotary press 2 and a chiller 3. A web 4 of printed material is received from the press 2 and passed through the dryer 1 to the chiller 3. Without limitation on the generality of useful applications of the dryer 1 comprising the present invention, it has been found to be particularly effective in web offset printing operations and hence the preferred embodiment of the present invention is disclosed in such an environment.

The dryer 1 of the present invention may also be employed for drying printed material in sheet form, ink or dye on fabric and various other coatings applied to or impregnated in various materials such as paper, paperboard stock, fabric, leather, metallic foil, plastic film and the like.

The term "drying" is likewise intended to encompass a variety of chemical and physical reactions which are induced by the dryer 1 of the present invention and generally involve the conversion of a liquid, especially one applied to a solid material, to a solid. The drying operation of the dryer 1 is largely effected by the evaporation of the solvent in printing ink. However, setting, hardening, oxydizing, colloidal thickening, molecular redistribution and polarization processes may also be effected or enhanced by the present invention on a wide variety of liquids applied to a wide variety of solids as aforementioned.

The dryer 1 generally comprises a frame structure 5, upper and lower heater panel assemblies 6, 7 an air handling system 8 and a power and control system 9.

I. Frame Structure

The frame structure 5 of the dryer 1 includes a front and a back 11, 12; left and right sides 13, 14; and a top and a base 15, 16. Front and back lower longitudinal members 17, 18 are positioned at the base 16 and the front and back 11, 12 respectively. A plurality of lower spacer members 19 are attached to and extend between the front and back lower longitudinal members 17, 18.

At the frame structure front and back 11, 12 opposed, upright pairs of front and back standards are attached to and extend upwardly from respective front and back lower longitudinal members 17, 18. The standards comprise front and back left standards 25, 26; front and back right standards 27, 28; front and back center standards 29, 30; and front and back intermediate standards 31, 32.

Front and back upper longitudinal members 37, 38 are attached to the upper ends of the front standards 25, 27, 29 and 31 and the back standards 26, 28, 30 and 32 at the frame structure top 15 and the front and back 11, 12 respectively. A blower support frame 39 is attached to the upper longitudinal members 37, 38.

Left and right lower members 41, 42 are positioned at the frame structure base 16 and left and right sides 13, 14 respectively. Left side front and back uprights 43, 44 extend upwardly from the left lower member 41 and are attached to the front and back left standards 25, 26 at the frame structure left side 13 and front and back 11, 12 respectively. Right side front and back uprights 45, 46 extend upwardly from the right lower member 42 and are attached to the front and back right standards 27, 28 at the frame structure right side 14 and front and back 11, 12 respectively.

Left and right upper members 47, 48 respectively are attached to and extend between the upper ends of the left side uprights 43, 44 and the right side uprights 45, 46 respectively. Upper spacer members 49 are attached to and extend between the upper longitudinal members 37, 38. At the frame structure front 11 an H-shaped subframe 53 is provided which includes a cross-piece 54 and left and right uprights 55, 56 attached to respective front intermediate standards 31.

A sheet metal lower front panel 63 is attached to the lower part of frame structure front 11. A sheet metal control panel 64 is mounted on the frame structure front 11 above the lower front panel 63. Left and right upper front sheet metal panels 65, 66 are attached to the frame structure front 11 and extend between the front left and right standards 25, 27 and the front intermediate standards 31 respectively. A back panel 67 is attached to the frame structure back 12.

Attached to the lower spacer members 19 and extending upwardly therefrom are respective bearing posts 71. A pillow block-type bearing 72 is mounted on the upper end of each linking drive shaft bearing post 71. The bearings 72 are adapted to receive a linking drive shaft 73 which extends between the frame structure left and right sides 13, 14. The linking drive shaft 73 is adapted for driving a piece of printing machinery, for example the chiller 3, on one side of the dryer 1 with another piece of printing machinery, for example the press 2, on the other side of the dryer 1.

The aforementioned components of the frame structure 5 may be connected by any suitable means including welding, bolting, riveting and the like or any combination thereof as appropriate. The frame structure 5 may be placed on a floor surface 69 with its base 16 on any suitable support or foundation, movable or fixed.

Heater Panel Assemblies

Each heater panel assembly 6, 7 includes a respective guide frame 81 comprising a pair of longitudinal rails 82 interconnected by respective crosspieces 83 forming an H-shaped configuration. Attached to each longitudinal rail 82 approximately midway along its length is a respective roller assembly 84 with upper and lower sets of respective left, right and middle rollers 85, 86 and 87. The left and right rollers 85, 86 are spaced a distance slightly greater than the widths of the center standards 29, 30 and rotatably engage respective center standard side faces 88. Rotational axes of the left and right rollers 85, 86 extend from front to back with respect to the dryer 1. The middle rollers 87 have rotational axes which extend from left to right with respect to the dryer 1 and rotatably engage respective center standard inner faces 89. The heater panel assemblies 6, 7 are thus guided in their vertical movements within the frame structure 5 along the "Y" axis by the guide frames 81. Left-to-right alignment of the heater panel assemblies 6, 7 with respect to the "X" axis is maintained by the left and right rollers 85, 86 and front to back alignment with respect to the "Z" axis is maintained by the middle rollers 87. Furthermore, the heater panel assemblies 6, 7 are maintained substantially level by providing upper and lower sets of rollers 85, 86 and 87 above and below each respective guide frame longitudinal rail 82.

The upper and lower heater panel assemblies 6, 7 are reciprocated within the frame structure 5 by an actuator comprising a double-acting pneumatic power cylinder 91 with an extensible and retractible rod 92. The cylinder 91 is mounted on a cylinder mounting crosspiece 93 attached to and extending horizontally between the front and back center standards 29, 30. As shown in FIG. 2, each cylinder standard 29, 30 includes a plurality of vertically spaced receivers 94 for bolts which extend through the center standards 29, 30 and into the opposite ends of the cylinder mounting crosspiece 93. The vertical placement of the cylinder 91 beneath the lower heater panel assembly 7 is determined by the corresponding opposite pair of receivers 94 chosen for mounting the crosspiece 93. The cylinder rod 92 terminates at a clevis 95 which is connected to the guide frame crosspiece 83 of the lower heater panel assembly 7.

The upper and lower heater panel assemblies 6, 7 are operably interconnected by a system comprising four steel cables 100 each having opposite upper and lower ends 101, 102. Each longitudinal rail 42 of the upper heater panel assembly 6 includes a pair of apertures (not shown) extending vertically therethrough for receiving respective cable upper ends 101. Each longitudinal rail 82 of the lower heater panel assembly 7 includes a pair of angle-section cable clips 103 having apertures (also not shown) therethrough for receiving the respective lower ends 102 of the cables 100. The cable ends 101, 102 are secured to respective guide frame longitudinal rails 82 by cable clamps 104 positioned below the longitudinal rails 82 of the upper heater panel assembly 6 and below the clips 103 attached to the longitudinal rails 82 of the lower heater panel assembly 7.

Figure 4:
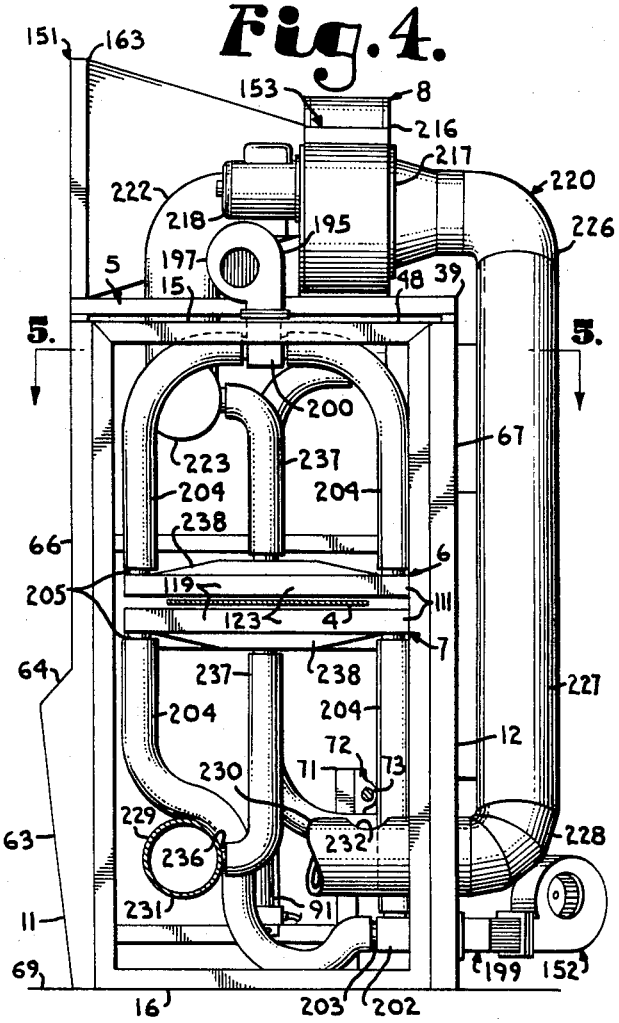
FIG. 4 is an elevational view of the right side of the dryer.
Figure 5:
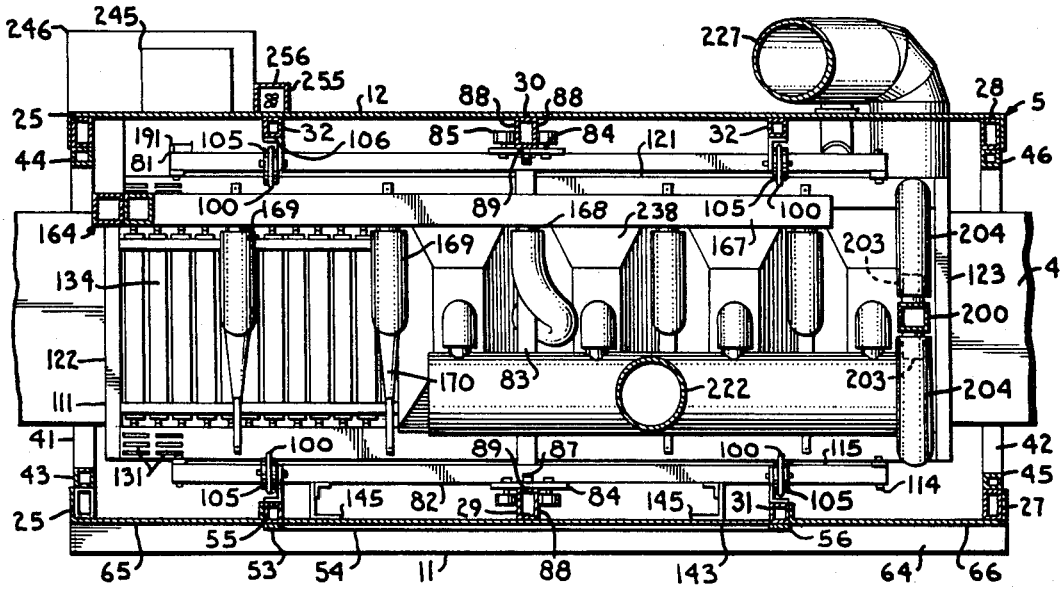
FIG. 5 is a horizontal section of the dryer taken generally along line 5—5 in FIG. 2.
Figure 6:
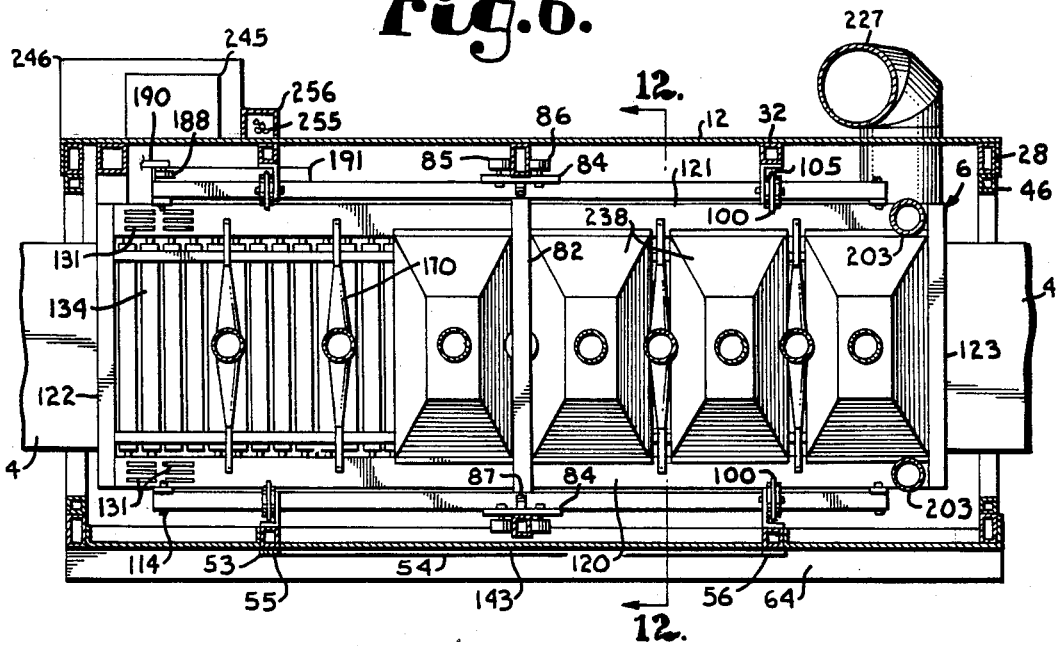
FIG. 6 is a horizontal section of the dryer taken generally along line 6—6 in FIG. 2.
Figure 7:
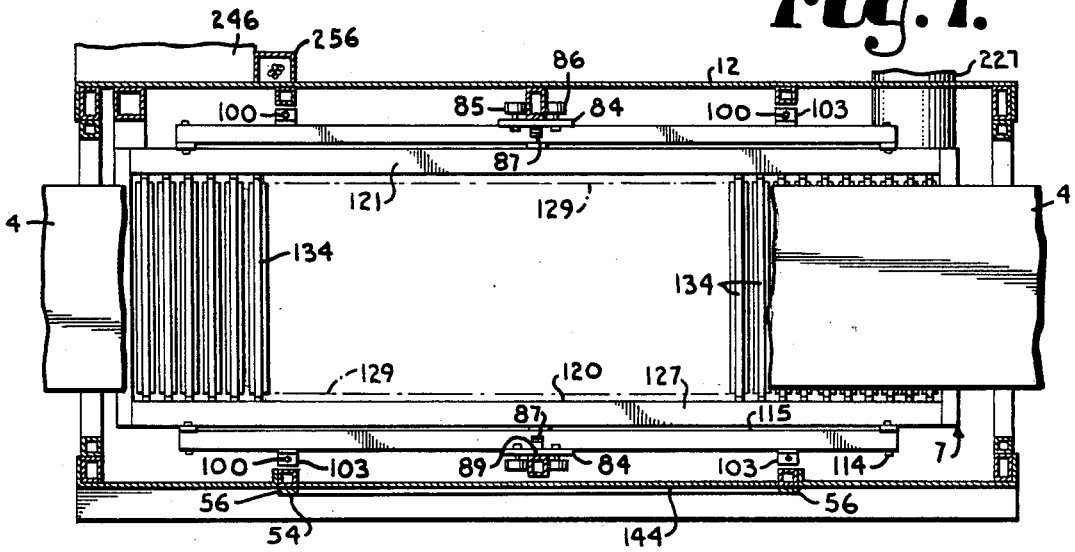
FIG. 7 is a horizontal section of the dryer taken generally along line 7—7 in FIG. 2.
Figure 8:
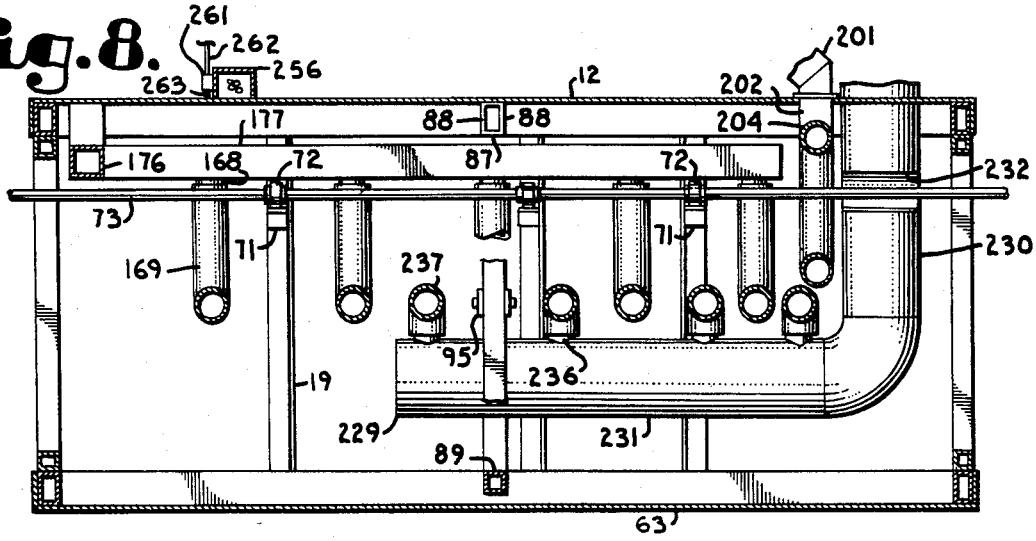
FIG. 8 is a horizontal section of the dryer taken generally along line 8—8 in FIG. 2.
Figure 9:
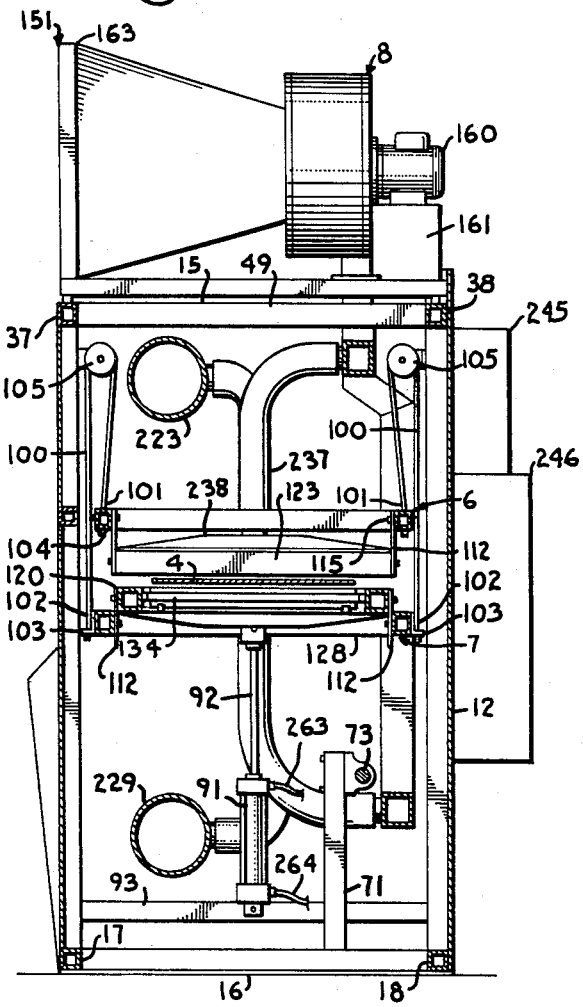
FIG. 9 is a vertical section of the dryer taken generally along line 9—9 in FIG. 2.
Figure 10:
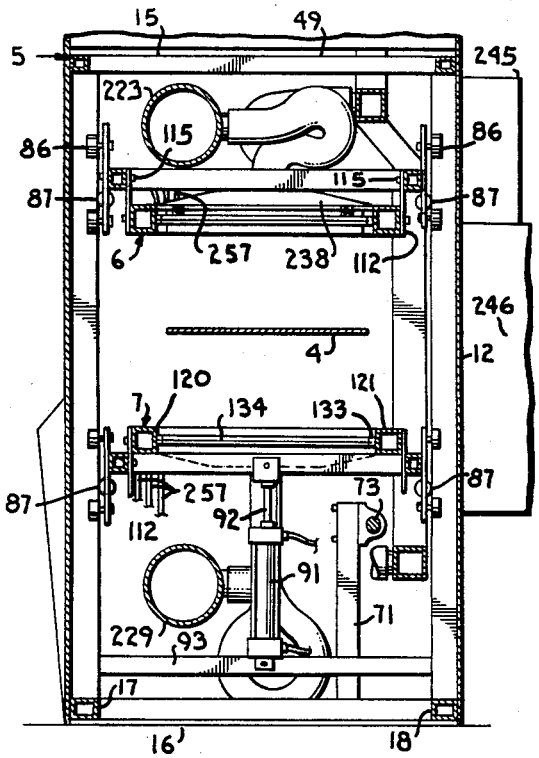
FIG. 10 is a fragmentary, vertical section of the dryer taken generally along line 10—10 in FIG. 2.
Figure 11:
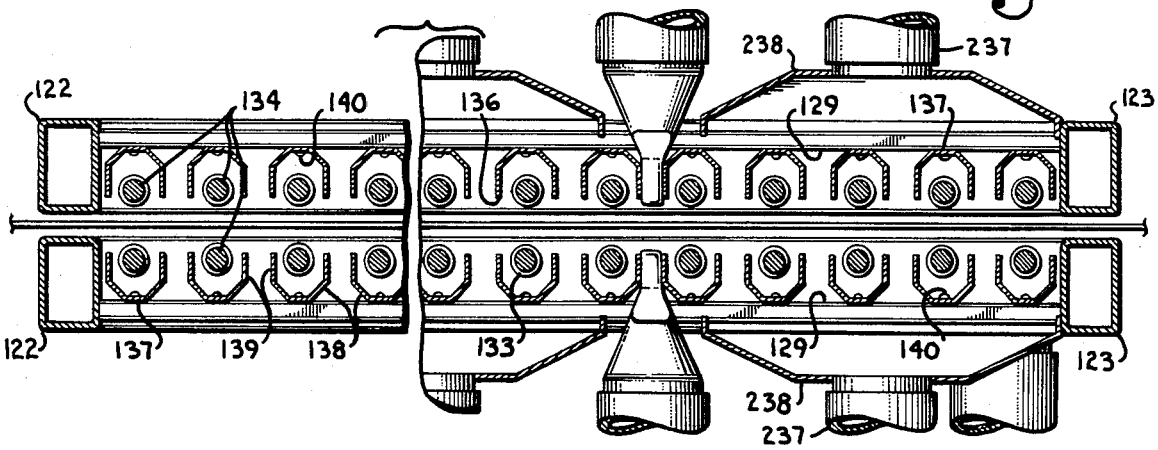
FIG. 11 is a fragmentary, vertical section of the dryer particularly showing heat lamp trays thereof and taken generally along line 11—11 in FIG. 6.
Figure 12:
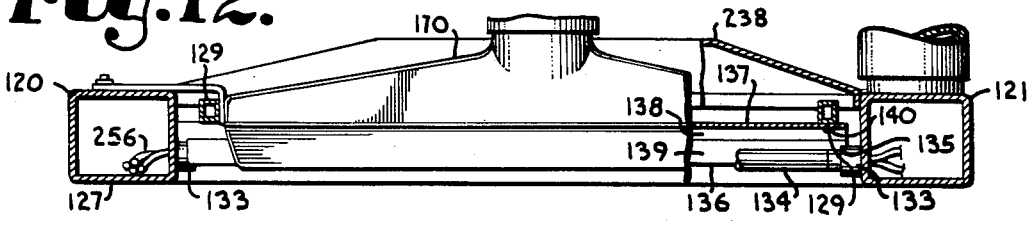
FIG. 12 is a fragmentary, vertical section of the dryer particularly showing a heat lamp tray and taken generally along line 12—12 in FIG. 11.

The cables 100 are trained over respective pulleys 105 attached to respective inner faces 106 of the intermediate standards 31, 32 adjacent their upper ends. When the heater panel assemblies 6, 7 are in their closed positions as shown in FIGS. 4 and 9, the upper heater panel assemblies 6, 7 are about 3 to 4 inches apart and the cables 100 assume a configuration as shown in FIG. 9 with their ends 101, 102 relatively close together. The heater panel assemblies 6, 7 are moved to their respective open positions as shown in FIG. 10 by retracting the cylinder rod 92 whereby the lower heater panel assembly 7 is lowered within the frame structure 5. The cables 100 are thus placed in tension and raise the upper heater panel assembly 6 to its open position. The geometry of each cable 100 and pulley 105 associated therewith is such that the vertical movements of the heater panel assemblies 6, 7 are directly porportional. Thus, in their respective open positions both heater panel assemblies 6, 7 are substantially the same distance from the paper web 4.

The steel cables 100 and the power cylinder 91 cooperate to provide a direct, simple and effective mechanical actuator means for opening and closing the heater panels 6, 7. By interconnecting the panels 6, 7 with the arrangement of cables 100 and pulleys 105, the opening and closing movements can be accomplished with a single power cylinder 91 and synchronization problems which might otherwise be encountered with more than one power cylinder are avoided. Furthermore, the cables 100 and pulleys 105 cooperate with the guide roller assemblies 84 to maintain the heater panel assemblies 6, 7 in horizontal, parallel alignment and prevent them from tipping in any direction.

The upper and lower heater panel assemblies 6, 7 include heat lamp trays 111 connected to respective guide frames 81 by connecting straps 112 adjacent the ends of each guide frame 81. The straps 112 have elongated slots 113 for receiving bolts 114 whereby they are adjustably attached to inside faces 115 of respective longitudinal rails 82. A respective connecting strap 112 is attached to each end of each longitudinal rail 82 whereby the guide frames 81 are connected to the heat lamp trays 111 by four mounting straps 112 each. The heat lamp trays 111 have rectangular configurations with fronts and backs 116, 117 respectively and left and right sides 118, 119 respectively. The heat lamp trays 111 are bordered by front, back, left and right square tubular raceways 120, 121, 122 and 123 respectively. Raceway flanges 129 project inwardly from the front and back raceways 120, 121. The connecting straps 112 are attached to the front and back raceways 120, 121.

Each heat lamp tray 111 includes a pair of rows of sockets 133 mounted in opposed relation on the front and back raceways 120, 121. The rows of sockets 133 extend from left to right substantially the entire length of the front and back raceways 120, 121 in horizontally aligned and evenly spaced relation. Each socket 133 is aligned front-to-back with a corresponding socket on the opposite raceway.

A plurality of quartz tube heat lamps 134 are placed in each heat lamp tray 111. The lamps 134 include respective opposite ends 135 which interlock with the sockets 133. The sockets 133 and the lamp ends 135 preferably comprise a non-electrically conductive insulating material, such as ceramic, capable of withstanding high temperatures.

The lamps 134 comprise nichrome elements enclosed in quartz tubes. Preferably, the lamps 134 are operated at relatively high temperatures (for example 1200 degrees to 1500 degrees Farhenheit) whereby short and medium wave infrared radiation with wavelengths in the respective ranges of 0.75 to 1.5 and 1.5 to 3.0 microns is produced. Short and medium wave infrared radiation is more intense and penetrates materials to be dried more deeply than long wave radiation with wavelengths in the range of 10 to 1000 microns.

The quartz tube heat lamps 134 used in the present invention, operating at high tempertures, have an estimated efficiency of 89% for conversion of input electricity into radiant heat for drying. Furthermore, a minimal amount of the short and medium wave radiant heat is lost to air absorption. The operating temperatures of the heat lamps 134 and the wavelengths of the radiant energy produced thereby are proportional to the level of input electricity. Lowering the level of input electricity results in lower lamp operating temperatures and proportionally longer wavelengths.

The quartz tube heat lamps 134 have been found to be particularly advantageous for drying ink on paper webs in high-speed rotary printing press operations. The infrared radiant energy produced thereby passes through air virtually undiminished and is almost completely absorbed after traveling a relatively short distance through most liquids and solids, for example printing ink on the paper web 4. The radiant energy produced by the lamps 134 is thus almost entirely expended in evaporating the ink solvent, varnish and pigments and effecting the other physical and chemical reactions associated with and necessary for the drying process. The infrared radiant energy produced by the quartz tube heat lamps 134 is also very effective for incinerating pollutants in the ink solvent, varnish and pigments whereby the exhaust from the dryer 1 has a relatively low level of pollutants which eliminates or at least reduces the amount of pollution control equipment required for its operation.

The efficiency of the lamps 134 is further increased by partially surrounding each lamp 134 with a polished aluminum reflector 136 for directing the infrared radiation toward the paper web 4. The reflectors 136 have flat, horizontal bases 137, respective pairs of angled proximate legs 138 and respective pairs of vertical, distal legs 139. The lamps 134 are positioned partly between the reflector distal legs 139. The reflectors 136 open inwardly toward the paper web 4 between the respective distal legs 139. The reflector bases 137 are fastened at their opposite ends to respective raceway flanges 129 by suitable mechanical fasteners 140. The reflectors 136 are thus placed in juxtaposed relation in each respective heat lamp tray 111 and extend from front to back with respect to the frame structure 5.

Upper and lower door panels 143, 144 are attached to the upper and lower heater panel assemblies 6, 7 respectively by vertically adjustable mounting brackets 145. The door panels 143, 144 are positioned in front of the heater panel assemblies 6, 7 and slidably engage the back of the H-shaped subframe 53 between the front intermediate standards 31. The door panels 143 and 144 move vertically with the heater panel assemblies 6, 7 between open and closed positions. Therefore, when the heater panel assemblies 6, 7 are in their open positions, the heat lamp trays 111 and interior of the frame structure 5 are accessible through the open door panels 143, 144.

III. Air Handling System

The drying effect of the heat from the heat lamps 134 is supplemented and enhanced by providing an air handling system 8 for mechanically induced forced air and exhaust. The air handling system 8 generally comprises a drying air subsystem 151, a cooling air subsystem 152 and an exhaust subsystem 153.

The drying air subsystem 151 includes a blower 158 with a fan 159 operably connected to a blower motor 160 mounted on a motor stand 161 attached to and positioned on top of the blower base frame 39. Drying air is drawn by the blower 158 through a drying air filter 162 in an intake 163.

The drying air blower 158 communicates forced air with a drying air duct network 164. The drying air duct network 164 includes a sheet metal, 90 degree first drying air elbow 165 communicating forced air from the drying air fan 159 to the frame structure top 15 whereat the drying airstream is split into upper and lower portions. The upper portion of the drying airstream is ducted through a 90 degree second drying air elbow 166 to an upper drying air manifold 167 which extends substantially the length of the frame structure 5 along the back 12 thereof.

The lower portion of the drying airstream is directed downwardly through third and fourth drying air elbows 173, 174 to a drying air vertical run 176 positioned alongside the back left standard 26 at the frame structure back 12. The vertical run 176 terminates at its lower end at a 90 degree fifth drying air elbow 175 communicating with a lower drying air manifold 177. A plurality of drying air sleeves 168 extend forwardly from the upper and lower drying air manifolds 167, 177 and are positioned in longitudinally spaced relation. Flexible drying air hoses 169 are each connected to a respective drying air sleeve 168 and terminate at drying air nozzles 170 attached to the heat lamp trays 111 of the upper and lower heater panel assemblies 6, 7. Forced air from the drying air subsystem 151 is directed through the nozzles 170 to the paper web 4 to facilitate drying the ink solvent thereon and also to provide an airstream across the web 4 and within the dryer 1 for removal of particulates, evaporated solvent, varnish, pigments and the like.

Figure 13:
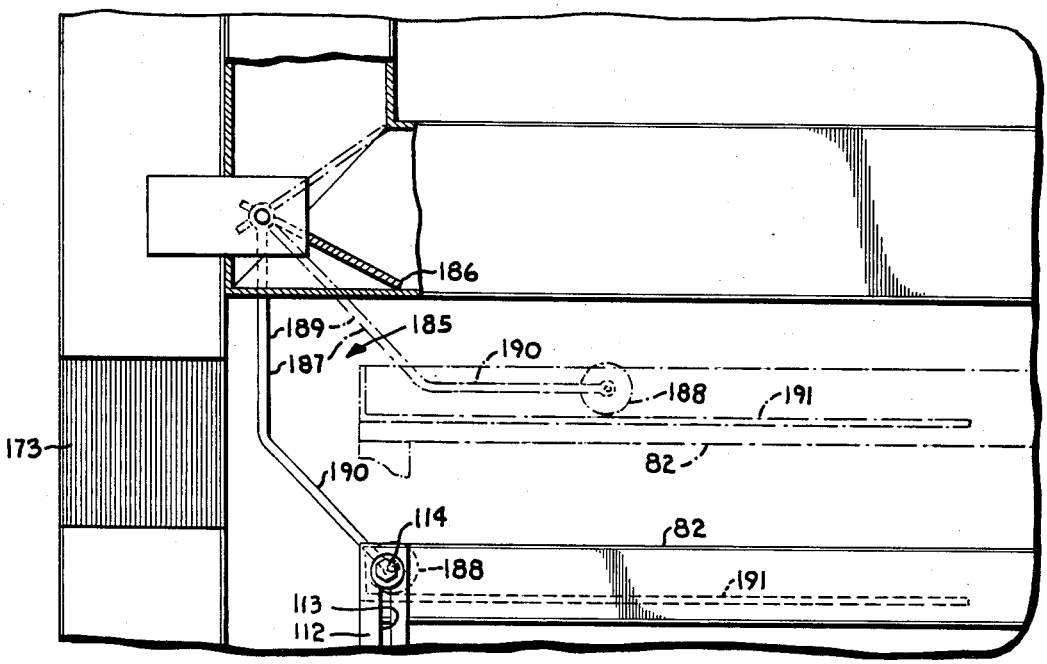
FIG. 13 is a fragmentary, front elevational view of a damper assembly in the dryer.
Figure 14:
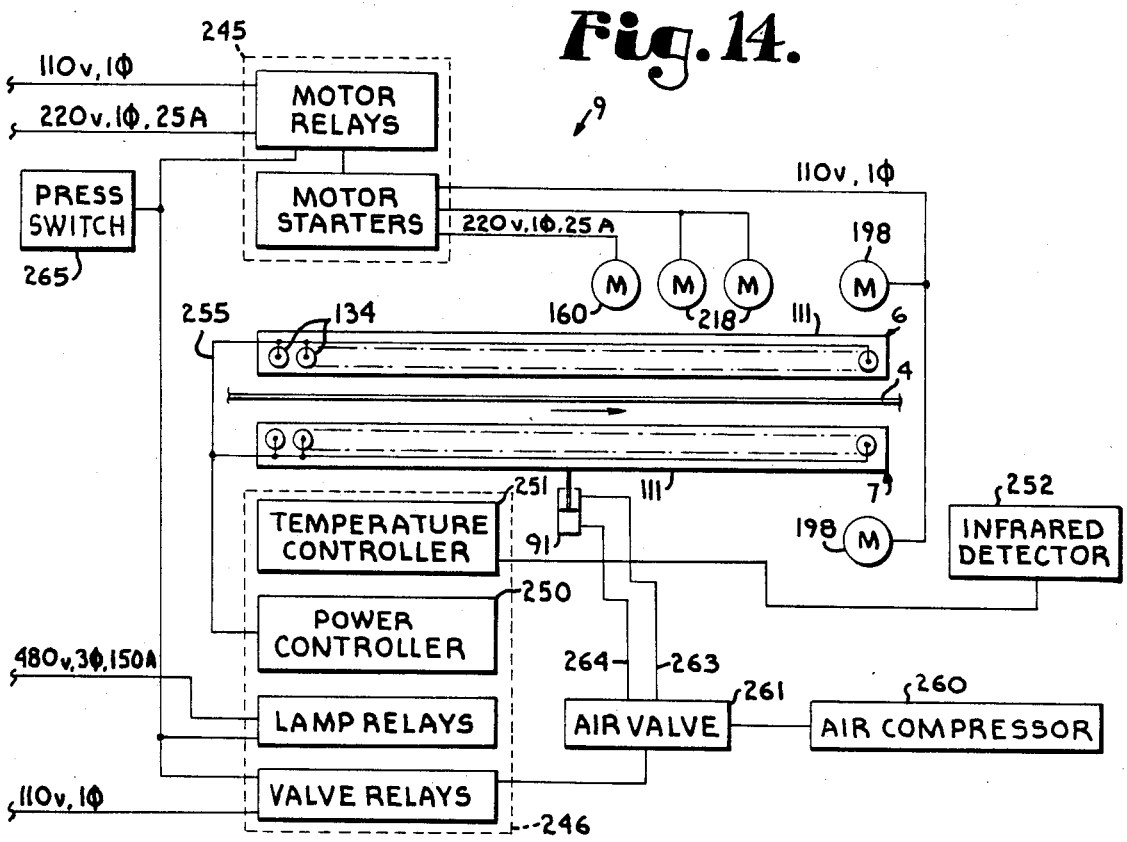
FIG. 14 is a schematic drawing of a power and control system of the dryer.

A damper assembly 185 is provided in the drying air subsystem 151 and includes a damper plate 186 pivotally mounted within the first drying air elbow 165. A damper actuator lever 187 is connected at one end to the damper plate 186 and has a roller 188 mounted at its other end. As shown in FIG. 13, the damper actuator lever is angled whereby a proximate leg 189 and a distal leg 190 are formed and are angularly disposed with respect to each other.

The actuator lever roller 188 rollably engages a roller track 191 extending forwardly from the inside face 115 of the guide frame longitudinal rail 92 of the upper heater panel assembly 6 in proximity to its left end. The damper assembly 185 is in its open position when the upper heater panel assembly is in its lowered, closed position whereby forced air is blown through upper portions of the drying air duct network 164 to the web 4 for facilitating the drying process. With the damper assembly 185 in its open position, the actuator lever roller 188 is at its left-most and lowest position as shown in FIG. 13.

When the heater panel assemblies 6, 7 are moved to their respective open positions, the roller 188 rolls along its track 191 to its right-most position as shown in phantom in FIG. 13 whereby the damper plate 186 is pivoted to its closed position for blocking air flow through the first drying air elbow 165 and thus to all of the upper portions of the drying air duct network 164. With the damper assembly 185 thus closed, all of the drying airstream is diverted to the lower portions of the drying air duct network 164 and blown upwardly through the lower drying air nozzles 170 against the underside of the web 4. The web 4 is thus supported on a cushion of air approximately midway between the open heater panel assemblies 6, 7, even though the lower heater panel assembly 7 is positioned in spaced relation some distance below the web 4. Supporting the web 4 in this fashion prevents it from sagging and coming into contact with hot portions of the lower heater panel assembly 7 which could conceivably set it afire due to the residual heat therein even though the heat lamps 134 are extinguished.

The cooling air subsystem 152 includes upper and lower cooling air blowers 195, 196 with respective cooling air blower fans 197 operably connected to respective cooling air blower motors 198. The upper cooling air blower 195 is mounted above the frame structure top 15 and its fan 197 is operably connected to a cooling air duct network 199 at an upper cooling air junction box 200 positioned beneath the frame structure top 15 adjacent the frame structure right side 14. The cooling air blower fan 197 of the lower cooling air blower 196 is connected to the cooling air duct network 199 at a 45 degree first cooling air elbow 201 mounted on the back side of the frame structure back panel 67 in proximity to the frame structure right side 14 and base 16. The first cooling air elbow 201 communicates with a lower cooling air junction box 202 positioned on the front side of the back panel 67.

Each upper and lower cooling air junction box 200, 202 has a pair of cooling air sleeves 203 extending therefrom and communicating with respective flexible cooling air hoses 204. The cooling air hoses 204 at their opposite ends receive respective cooling air sleeves 203 located at the corners of the heat lamp trays 111 where the front and back raceways 120, 121 intersect the right raceway 122.

In operation, the cooling air blowers 195 force air through the cooling air duct network 199 to the front and back lamp tray raceways 120, 121. The cooling air is blown through the raceways 120, 121 to remove excess heat therefrom. The cooling air is exhausted through raceway louvres 131 at the left ends of the front and back raceways 120, 121. Cooling means for the raceways 120, 121 is provided because heat generated by the elecrical current in heat lamp wires 256 and the heat lamps 134 might create a fire hazard or otherwise damage the dryer 1.

The exhaust subsystem 153 includes upper and lower exhaust blowers 215, 216 mounted on the blower base frame 39 and drawing exhaust from the dryer 1 through an exhaust duct network 220. Each exhaust blower 215, 216 includes a respective exhaust blower fan 217 operably connected to a respective exhaust blower motor 218 mounted on a respective exhaust motor stand 219. The blower motor stands 219 are attached to the blower base frame 39.

The fan 217 of the upper exhaust blower 215 communicates with a first exhaust elbow 221 which extends through the frame structure top 15 and terminates at a "T" connection 222 with an upper exhaust manifold 223 extending from left-to-right slightly below the frame structure top 15. The upper exhaust manifold 223 is suspended from the upper spacers 49 of the frame structure 5 by hangers 224.

The lower exhaust blower 216 receives air from a second exhaust elbow 226 at the upper end of an exhaust run 227. At the lower end of the exhaust run 227 a 90 degree third exhaust elbow 228 extends through the back panel 67 of the frame structure 5. Inside the frame structure 5, the third exhaust elbow 28 draws air from a lower exhaust manifold 229 including a front-to-back leg 230 and a left-to-right leg 231.

The exhaust duct network 220 includes a plurality of exhaust sleeves 236 extending rearwardly from the upper exhaust manifold 223 and the left-to-right leg 231 of the lower exhaust manifold 229. The exhaust sleeves are received in ends of flexible exhaust hoses 237 which receive exhaust hoods 238 in their opposite ends. Each exhaust hood is mounted on a respective heat lamp tray 111 on the respective front and back raceways 120, 121. The exhaust hoods 238 are provided over approximately the right-most two-thirds of the heat lamp trays 111 and each covers a plurality of heat lamps 134. The exhaust hoods 238 are not provided on the remaining left-most portions of the heat lamp trays 111 because the web 4 is relatively cool there and emits most of its evaporated solvent, varnish and pigment further to the right after being heated. Furthermore, the rapidly moving paper web 4 tends to impart inertia to the exhaust whereby it tends to be carried along with the moving paper web to the right where it are drawn off by the exhaust hoods 238. The exhaust is drawn from the moving web 4 and its surrounding vicinity and thence through the exhaust duct network 220 to the exhaust blower fans 217 from which it may be exhausted to, for example, a roof vent or pollution control equipment.

The radiant energy from the quartz tube heat lamps 134 and the forced air from the air handling system 8 cooperate to reduce the level of pollutants both within the dryer 1 and in its exhaust. The radiant energy tends to incinerate much of the evaporated solvent, varnish and pigment or at least convert it to a less harmful condition within the dryer 1. The air flow established by the air handling system 8 effectively removes most of the remaining solvents, varnishes and pigments and the by-products of the radiant thermal incineration. Therefore, only very small amounts of the aforementioned substances accumulate within the dryer 1 and a relatively clean drying operation is effected.

Power and Control System

With the exception of the pneumatic cylinder 91, the dryer 1 of the present invention operates on electrical power. The power and control system 9 therefor includes an upper electrical enclosure 245 with power relays and starters for the motors 160, 198 and 218. The drying air blower motor 160 and the exhaust blower motors 218 require 220 volt, single phase, 25 ampere current in the preferred embodiment. The cooling air blower motors 198 operate on 110 volt service. The upper electrical enclosure 245 is mounted on the back panel 67 adjacent the left side 13 of the frame structure 5. A lower electrical enclosure 246 is mounted on the frame structure back panel 67 directly below the upper electrical enclosure 245.

The lower electrical enclosure 246 houses a power controller 250 for the heat lamps 134. In the disclosed embodiment, the heat lamps 134 are provided with 480 volt, three phase, 150 ampere service. However, without limitation, electrical service for the heat lamps 134 in the range of 220 to 575 volts is contemplated. The power controller 250 is operably connected to a temperature controller 251 which is also housed within the lower electrical enclosure 246. A thermal-type infrared detector 252 is mounted on the frame structure right side 14 adjacent the path of the web 4 where it exits the dryer 1 and is operably connected to the temperature controller 251. The resistance of the infrared detector 252 is proportional to the heat of the paper web 4. The temperature controller 251 generates a milliampere signal with a value determined by the resistance of the infrared dectector 252 and a preset temperature range for the web 4 which is programmed into the temperature controller 251. The signal generated by the temperature controller 251 is transmitted to the power controller 250. The temperature controller 251 includes a digital display for indicating the temperature of the web 4.

The power controller 250 and the temperature controller 251 cooperate with the infrared detector 252 to automatically and constantly adjust the level of current to the heat lamps 134 and thereby maintain the temperature of the web 4 within relatively close tolerances. The web 4 is thus exposed to sufficient heat for effective drying of the ink thereon without excessive heat exposure which could scorch or even ignite the web 4. As an alternative to the aforementioned automatic heat control system, a potentiometer could be provided for manually controlling the current to the heat lamps 134 and the temperature of the web 4.

A vertical wiring trough 255 protrudes from the frame structure back panel 67 to the right of the electrical enclosures 245, 246. Heat lamp wires 255 extend from the power controller 250, through the wiring trough 255, into the interior of the frame structure 5 and through respective heat lamp tray raceways 120, 121 and 122 to respective electrodes (not shown) at each socket 133. Between the lower electrical enclosure 346 and the heat lamp trays 111, the heat lamp wires 255 are enclosed within flexible electrical conduit 257. Within the front and back raceways 120, 121 the heat lamp wires 255 are cooled by the cooling air subsystem 152.

Compressed air from an air compressor 260 is communicated to a two-way solenoid-actuated air valve 261 mounted on the wiring trough 255 by a compressor air line 262. Upper and lower air lines 263, 264 communicate pressurized air from the air valve 261 to respective upper and lower ends of the cylinder 91. In its normal first position the air valve 261 operably connects the compressor 260 and the upper air line 263 whereby pressurized air is communicated to the upper end of the cylinder 91. The rod 92 is thus retracted and the heat lamp trays 111 are open. When the solenoid of the air valve 261 is actuated, the upper air line 263 is closed and pressurized air is admitted through the lower air line 264 to the lower end of the cylinder 91 whereby the rod 92 is extended and the heat lamp trays 111 are closed.

The power cylinder 91 and the air valve 261 cooperate to automatically open the heater panel assemblies 6, 7 in the event of a power outage or other malfunction. When the electrical power to the dryer 1 is interrupted, the heat lamps 134 extinguish but retain substantial amounts of residual heat for several seconds in spite of their relatively low thermal masses. If the press 2 and other printing equipment are also effected, the web 4 may stop within the dryer 1 and thus be susceptible to scorching or ignition if the heater panels 6, 7 are not immediately removed from the web 4.

The pneumatic system of the dryer 1 is designed to automatically open the heater panels 6, 7 in the event of a power outage. The air valve 261 is immediately biased by a return spring (not shown) to its first position when its solenoid is deactivated. Pressurized air is thus communicated to the upper end of the cylinder 91, the rod 92 retracted and the heater panel assemblies 6, 7 vertically moved to their respective open positions a sufficiently safe distance from the web 4.

The entire power and control system 9 of the dryer 1 is actuated by a switch 265 on the first impression cylinder (not shown) of the press 2. When the press 2 is operating, the microswitch closes and relays within the electrical enclosures 245 and 246 actuate the blower motors 160, 198 and 218 respectively; the heat lamps 134; and the solenoid of the air valve 261. The dryer 1 is thus operational and functions to dry the paper web 4 passing therethrough. When the press 2 stops for any reason, the switch 265 opens and the dryer 1 is shut down with its heat lamp trays 111 open.

It is to be understood that while certain forms of the present invention have been illustrated and described herein, it is not to be limited to the specific forms or arrangement of parts described and shown.

What is claimed and desired to be secured to be secured by Letters Patent is as follows:

1. A dryer for printed materials and the like which comprises:

(a) a frame structure;

(b) a pair of heater panel assemblies movably mounted within said frame structure, each said heater panel assembly including:

(1) a heat lamp; and (2) guide means for guiding the movement of said heater panel assembly within said frame structure;

(c) actuating means for moving said heater panel assemblies between open and closed positions; and (d) an air handling system including an air blower and duct means operably connected to said air blower and at least one of said heater panel assemblies for communicating air with printed material in said dryer.

2. The dryer according to claim 1 wherein said air handling system includes:

(a) a drying air subsystem comprising:

(1) said air blower;

(2) a drying air nozzle mounted on said heater panel assembly for directing a flow of drying air to said printed material; and (3) a drying air duct network communicating drying air from said air blower to said drying air nozzle.

3. The dryer according to claim 1 wherein said air handling system includes:

(a) an exhaust subsystem comprising:

(1) an exhaust blower;

(2) an exhaust hood mounted on said heater panel assembly; and (3) an exhaust duct network communicating exhaust from said exhaust hood to said exhaust blower.

4. The dryer according to claim 1 which includes:

(a) said heat lamp comprising a plurality of quartz tube heat lamps arranged in juxtaposed, coplanar relation.

5. The dry according to claim 1 which includes:

(a) a plurality of reflectors each partially surrounding a respective heat lamp.

6. The dryer according to claim 1 wherein:

(a) said actuating means includes a pneumatic power cylinder.

7. The dryer according to claim 1 which includes:

(a) said heater panel assembly including a raceway;

(b) heat lamp wires positioned in said raceway and connected to said heat lamps; and (c) said air handling system including a cooling air subsystem mounted on said frame structure and having:

(1) a cooling air blower; and (2) a cooling air duct network communicating cooling air from said cooling air blower to said raceway.

8. The dryer according to claim 4 which includes:

(a) said dryer being adapted for drying a moving web of printed material; and (b) control means operably connected to said heat lamps and adapted to control the output thereof and to maintain a predetermined web temperature, said control means including heat sensing means mounted on said frame adjacent the path of said web.

9. The dryer according to claim 1 wherein:

(a) said heater panel assembly includes a plurality of rollers rollably engaging said frame structure for guiding said heater panel assembly between its open and closed positions.

10. A dryer for printed materials and the like, which comprises:

(a) a frame structure;

(b) upper and lower heater panel assemblies vertically movably mounted within said frame structure, each said heater panel assembly including:

(1) a plurality of juxtaposed, substantially coplanar quartz tube heat lamps extending across said heater panel assembly; and (2) guide means for guiding the movement of said heater panel assemby within said frame structure;

(c) actuator means for moving said heater panel assemblies between open positions and closed positions; and (d) an air handling system including an air blower and duct means operably connected to said air blower and said heater panel assemblies for communicating air with printed material in said dryer.

11. The dryer according to claim 10 wherein said air handling system includes:

(a) a drying air subsystem comprising:

(1) a dryer air blower;

(2) a plurality of drying air nozzles each mounted on a respective upper and lower heater panel assembly for directing a flow of drying air to said printed material; and (3) a drying air duct network communicating drying air from said drying air blower to said drying air nozzles.

12. The dryer according to claim 11 which includes:

(a) said drying air subsystem including a damper assembly in said duct network, said damper assembly having an open position allowing air to flow through said drying air duct network to said upper heater panel assembly and a closed position substantially blocking air flow through said drying air duct network to said upper heater panel assembly.

13. The dryer according to claim 10 wherein said air handling system includes:

(a) an exhaust subsystem comprising:

(1) an exhaust blower;

(2) an exhaust hood mounted on said heater panel assembly; and (3) an exhaust duct network communicating exhaust from said exhaust hood to said exhaust blower.

14. The dryer according to claim 10 which includes:

(a) said heater panel assembly including a raceway;

(b) heat lamp wires positioned in said raceway and connected to said heat lamps; and (c) said air handling system including a cooling air subsystem mounted on said frame structure and having:

(1) a cooling air blower; and (2) a cooling air duct network communicating cooling air from said cooling air blower to said raceway.

15. The dryer according to claim 10 which includes:

(a) a plurality of reflectors each partially surrounding a respective heat lamp.

16. A dryer according to claim 10 wherein:

(a) said actuator means includes a pneumatic power cylinder.

17. The dryer according to claim 16 which includes:

(a) said power cylinder being operably connected to said lower heater panel assembly; and (b) suspension means connected to said framework and said heater panel assemblies, said suspension means supporting said upper heater panel assembly and moving said upper heater panel assembly between its open and closed positions in response to respective movements of said lower heater panels assembly between its open and closed positions.

18. The dryer according to claim 17 wherein said suspension means includes:

(a) pully means mounted on said frame above said upper and lower heater panel assemblies; and (b) cable means trained over said pulley means and having an upper and a lower end attached to said upper and lower heater panel assemblies respectively.

19. The dryer according to claim 10 which includes:

(a) said dryer being adapted for drying a moving web of printed material; and (b) control means operably connected to said heat lamps and adapted to control the output thereof and to maintain a predetermined web temperature, said control means including heat sensing means mounted on said frame adjacent the path of said web.

20. The dryer according to claim 10 which includes:

(a) said dryer being adapted for drying a moving web of printed material; and (b) control means operably connected to said actuator means and said heat lamps for causing said heater panel assemblies to move to their open positions and for causing said heat lamps to extinguish in response to a stoppage of said web.

21. The dryer according to claim 10 wherein each said heater panel assembly includes:

(a) a plurality of rollers rollably engaging said frame structure.

22. A dryer for printed materials and the like, which comprises:

(a) a frame structure with front and back vertical standards;

(b) upper and lower heater panel assemblies vertically movably mounted within said frame structure, each said heater panel assembly including:

(1) a guide frame with front and back longitudinal members each having a plurality of rollers mounted thereon adapted for engaging said frame structure standards;

(2) a heat lamp tray with front, back, left and right raceways, said heat lamp tray of said upper heater panel assembly being attached to and suspended below a respective guide frame of said upper heater panel assembly and said heat lamp tray of said lower heater panel assembly being attached to and supported above a respective guide frame of said lower heater panel assembly;

(3) a plurality of juxtaposed and substantially coplanar quartz tube heat lamps extending across said heat lamp tray between respective opposite raceaways;

(4) a plurality of reflectors attached to and extending across said heat lamp tray, each said reflector partially surrounding a respective heat lamp and being open in the direction of the other said heater panel assembly; and (5) each said front and back raceway having a respective opening at an end thereof;

(c) a pneumatic cylinder mounted on said frame structure and having an extensible and retractible rod attached to said guide frame of said lower heater panel assembly;

(d) front and back pairs of pulleys attached to said frame structure;

(e) a plurality of cables each trained over a respective pully and having an upper end attached to said upper heater panel assembly and a lower end attached to said lower heater panel assembly;

(f) a drying air subsystem including:

(1) a blower mounted on said frame structure;

(2) a duct network extending from said blower and including upper and lower manifolds mounted within said frame structure above and below said upper and lower heater panel assemblies respectively and a plurality of flexible drying air hoses communicating with said drying air manifolds; and (3) a plurality of nozzles mounted on said heat lamp trays between respective heat lamps and receiving forced air from said flexible hoses;

(g) a cooling air subsystem including:

(1) upper and lower cooling air blowers mounted on said frame structure; and (2) a cooling air duct network including a plurality of flexible cooling air hoses communicating said upper and lower cooling air blowers with said raceways of said upper and lower heater panel assemblies; and (h) an exhaust air subsystem including:

(1) upper and lower exhaust blowers;

(2) an exhaust duct network including upper and lower exhaust manifolds communicating with said upper and lower exhaust blowers respectively and a plurality of flexible hoses each connected to a respective exhaust manifold; and (3) a plurality of exhaust hoods mounted on said upper and lower heater panel assemblies and connected to respective flexible hoses for communication with said exhaust manifolds;

(i) said heater panel assemblies having respective open positions in relatively widely spaced relation and respective closed positions in relatively closely spaced relation, said lower heater panel assembly being reciprocated between its open and closed positions by said pneumatic cylinder and said upper heater panel assembly being reciprocated between its upper and lower positions by said cables.

23. A method of drying a web of printed material, which comprises the steps of:

(a) detecting movement of a printed material web with respect to a dryer;

(b) moving a pair of heater panel assemblies each including a heat lamp to a closed position whereat said heat lamps are in close proximity to said printed material web from an open position with said heat lamps spaced relatively further from said printed material web, said movements being guided by guide means;

(c) actuating said heat lamps; and (d) blowing air from an air blower through a duct to at least one said heater panel assembly for communication with said printed material in said dryer to facilitate drying said printed material.

24. The method according to claim 23 wherein:

(a) said heat lamps comprise a plurality of juxtaposed, substantially coplanar quartz tube heat lamps extending across said heater panel assembly.

25. The method according to claim 23 wherein:

(a) said heater panel assemblies are operably interconnected whereby movement of one said heater panel assembly results in a corresponding movement of said other heater panel assembly.

26. The method according to claim 23 which includes the additional step of:

(a) collecting and exhausting evaporated solvents from said printed material.

27. The method according to claim 23 which includes the additional step of:

(a) sensing the heat of said printed material web and controlling the output of said heat lamps in response thereto.

28. The method according to claim 23 which includes the addtional steps of:

(a) detecting a stoppage of said web of printed material; and (b) moving said heater panel assemblies to said open positions.

29. The method according to claim 23 which includes the addtional step of:

(a) extinguishing said heat lamps.

30. The method according to claim 23 which includes the additional step of:

(a) incinerating pollutants from said printed material within said dryer.

* * * * *